US005664749A

United States Patent [19]

Kump et al.

[11] Patent Number: 5,664,749

[45] Date of Patent: Sep. 9, 1997

[54] ADJUSTABLE SIGN HOLDERS

[75] Inventors: Daniel J. Kump, Mentor; Gerald A. Conway, Pepper Pike; Anthony J. Lammers, Gates Mills, all of Ohio

[73] Assignee: Fasteners For Retail, Inc., Cleveland, Ohio

[21] Appl. No.: 538,979

[22] Filed: Oct. 5, 1995

[51] Int. Cl.[6] ..... A47B 96/06

[52] U.S. Cl. ..... 248/220.22; 248/205.3; 248/223.31; 248/225.11; 248/473

[58] Field of Search ..... 248/205.3, 220.21, 248/220.22, 222.11, 223.31, 223.41, 224.61, 224.7, 225.11, 309.1, 473, 475.1; 40/606, 661

[56] References Cited

U.S. PATENT DOCUMENTS

| | | | |
|---|---|---|---|
| 2,534,741 | 12/1950 | Swenson . | |
| 2,977,082 | 3/1961 | Harris . | |
| 3,422,556 | 1/1969 | Lyons et al. . | |
| 3,525,493 | 8/1970 | Chrietzberg et al. | 248/220.21 |
| 3,698,111 | 10/1972 | Smith . | |
| 3,787,922 | 1/1974 | Foy et al. | 248/473 X |
| 3,797,151 | 3/1974 | Dexter . | |
| 4,387,520 | 6/1983 | Ahrens | 40/606 X |
| 4,473,963 | 10/1984 | Hardy et al. | 248/205.3 X |
| 4,677,780 | 7/1987 | Shuman . | |
| 4,757,623 | 7/1988 | Seyler . | |
| 4,866,868 | 9/1989 | Kass | 40/661 |
| 4,960,258 | 10/1990 | Stocker et al. . | |
| 5,029,378 | 7/1991 | Stocker et al. . | |
| 5,176,522 | 1/1993 | Robertson, Jr. . | |
| 5,331,757 | 7/1994 | Ernest et al. | 40/661 X |

FOREIGN PATENT DOCUMENTS 1959606 6/1971 Germany .

OTHER PUBLICATIONS

Fasteners For Retail—1995 Buyers Guide (cover page and p. 36) no specific date of publication.

HL Display 1995 Catalog (cover page and pp. 51 and 59) no specific date of publication.

*Primary Examiner*—Leslie A. Braun
*Assistant Examiner*—Gwendolyn W. Baxter
*Attorney, Agent, or Firm*—Fay, Sharpe, Beall, Fagan, Minnich & McKee

[57] ABSTRACT

An apparatus for supporting a sign element on a fixture includes a left side support member and a right side support member with each of the support members being separated from the other and being free standing. Each support member includes a support surface and an engagement surface that is oriented substantially transverse to the support surface. A substantially linear side groove is located along a length of the engagement surface of each of the left and right support members. A left side base and a right side base are provided on which a respective one of the support members is mounted. Preferably the bases each have a projection extending into a recess formed in a housing of the support member for engaging a wall of the housing.

21 Claims, 9 Drawing Sheets

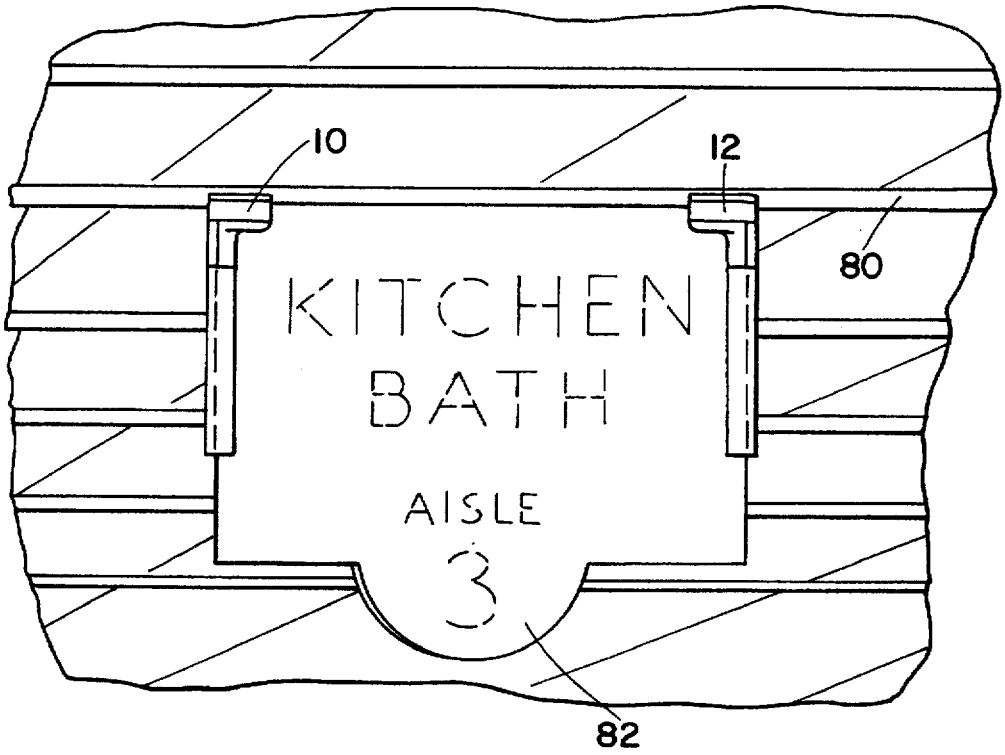
FIG. 6
FIG. 7
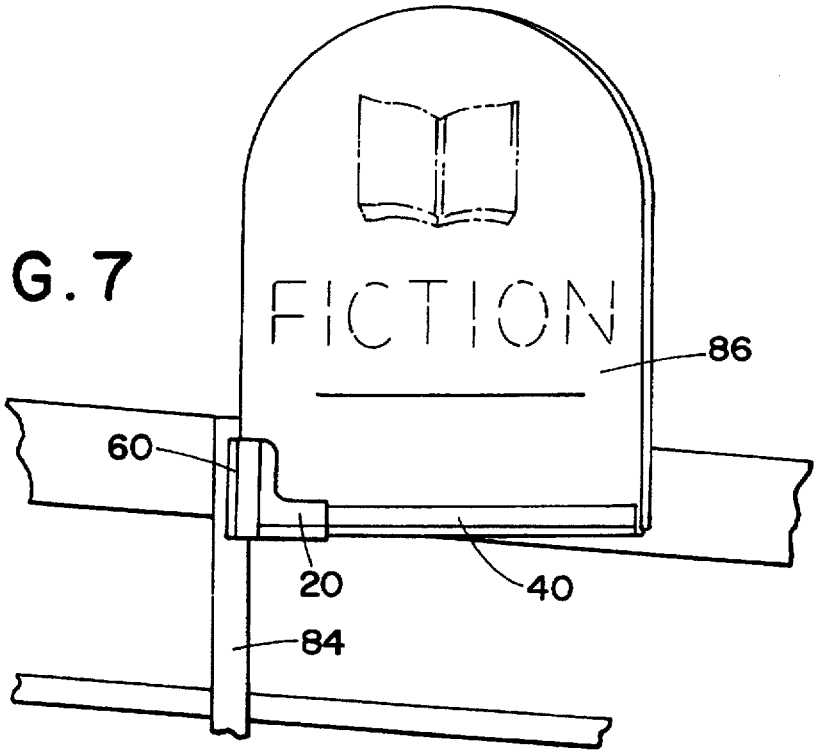

ADJUSTABLE SIGN HOLDERS

BACKGROUND OF THE INVENTION

The present invention relates to sign holders. More particularly the instant invention relates to a universally adjustable sign holder and ways of securing such a sign holder to a support surface.

Systems for mounting and supporting signs on associated base fixtures have generally required that the sign be housed in a frame with the frame then being secured to a mounting surface of the fixture. All such mounting systems are designed or adapted for a sign of a particular size and thickness. Consequently, a large number of different sizes and shapes of display signs require an equally large number of differently adjusted and configured sign mounting systems. Obviously, a large inventory of such sign mounting systems is costly and difficult to store. Some sign systems are known that have a range of adjustability. However, these require that at least the sign frame structure be modified to accommodate different sizes of signs. Furthermore, such adjustable sign frames are more costly and complex than are the non-adjustable constructions.

It is known to use magnetic attaching means for securing a sign frame to a mounting surface or fixture. Numerous sign frame structures with magnetically attractive mounting systems are known in the art. Recently, a frameless magnetically secured adjustable sign holder system has been developed. This system is described in U.S. Pat. No. 4,960,258. The disclosure of that patent is incorporated herein by reference in its entirety.

However, this known sign system is only useful when the mounting surface is made of a magnetic field conductive material. If the mounting surface is made of a plastic or of another non-magnetic material, such as wood, this known frameless sign holder cannot be secured to the support fixture. This known sign holder is also incapable of holding thin sheets of sign material in a sturdy manner so that they do not fall out of the sign holder. Moreover, the known sign holder is not adapted for use on poles or other support bars, nor can it be clipped to a ceiling grid or the like.

Accordingly, it has been considered desirable to develop a new and improved adjustable sign holder which would overcome the foregoing difficulties and others while providing better and more advantageous overall results.

BRIEF SUMMARY OF THE INVENTION

In accordance with the present invention, a new and improved apparatus for supporting a sign element on a fixture is provided.

More particularly in accordance with this aspect of the invention, the apparatus comprises a left side support member and a right side support member, each of the support members being separated from the other and being free standing. Each support member includes a support surface and an engagement surface oriented substantially transverse to the support surface. A substantially linear side groove is located along a length of the engagement surface of each of the left and right side support members. A left side base and a right side base are provided on which a respective one of the support members is mounted.

According to another aspect of the present invention, an apparatus is provided for mounting a sign element on a fixture.

In accordance with this aspect of the invention, the apparatus comprises a free standing support member, the support member being L-shaped and including a support section and an engagement section oriented substantially transverse to the support section. A substantially linear groove is located along a length of the engagement section. A rail can be mounted in the side groove wherein the rail comprises a pair of side walls that taper towards each other. The support member cooperates with a base on which it is mounted. The base, in turn, contacts the fixture.

One advantage of the present invention is the provision of a new and improved adjustable sign holder.

Another advantage of the present invention is the provision of a sign holder which can include a frameless mounting configuration.

Still another advantage of the present invention is the provision of a sign holder that can be secured either to a metal fixture via magnetic attraction or to a non-metal fixture via other securing means, such as adhesive, suction cups, clips or the like.

Yet another advantage of the present invention is the provision of a sign holder which is capable of holding signs of a variety of thicknesses and sizes.

A further advantage of the present invention is the provision of a sign holder which is capable of holding a sign to a mounting rail, an overhead channel, a ceiling grid and the like, as well as to subjacent support surfaces.

A still further advantage of the present invention is the provision of a sign holder which is capable of pivoting from side to side so that if the sign holder unit is bumped, it will pivot out of the way and return to its normal position.

A yet further advantage of the present invention is the provision of a sign holder system which allows a pair of spaced boots supporting the sign to be radially adjusted enabling the sign to be displayed at a variety of angles in relation to a vertical axis.

An additional advantage of the present invention is the provision of a sign holder system which allows an L-shaped support shoe to be secured to a variety of bases so as to enable the L-shaped support shoe and a rail, which can be secured therein, to be supported on any desired type of fixture. When the sign holder system is moved to another type of fixture, the base used can be removed and replaced by a base which is adapted for that type of fixture.

A yet further advantage of the present invention is the provision of a framed mounting configuration including a pair of L-shaped support shoes, mounted on bases, two side rails and a top rail connected to the side rails by corner pieces. This mounting configuration can be used to mount a dry wipe board on a fixture. Of course, it can also be used to mount a sign on the fixture.

Still other benefits and advantages of the invention will become apparent to those skilled in the art upon a reading and understanding of the following detailed specification.

BRIEF DESCRIPTION OF THE DRAWINGS

The invention may take physical form in certain parts and arrangements of parts, preferred embodiments of which will be described in detail in this specification and illustrated in the accompanying drawings which form a part hereof and wherein:

FIG. 6 is a perspective view of the sign holder system according to the present invention as it can be used to support a sign from a ceiling grid;

FIG. 7 is a perspective view of a sign holder system according to the present invention as it can be used to support a sign from a vertically extending shelf member;

DETAILED DESCRIPTION OF THE PREFERRED EMBODIMENTS

Figure 1:
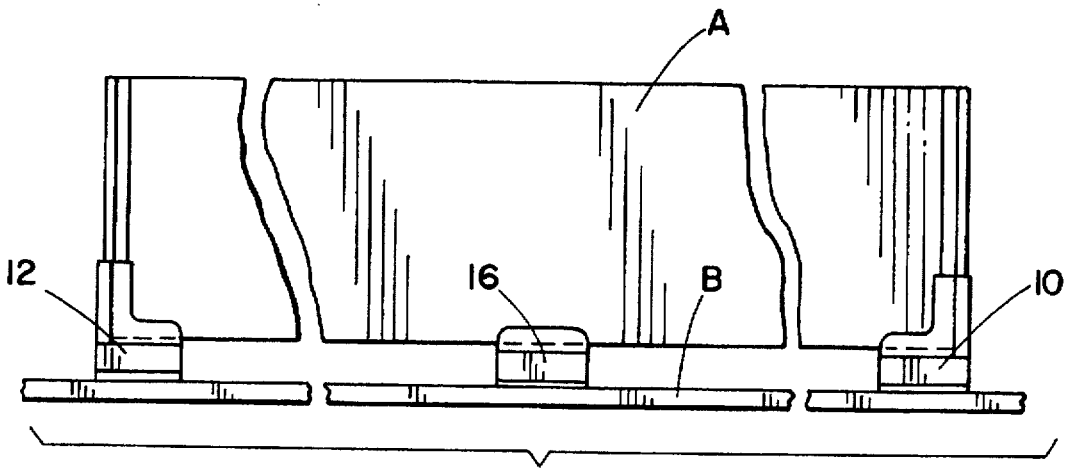
FIG. 1 is a side elevational view, partially broken away, of a sign holder system according to a preferred embodiment of the present invention.

Referring now to the drawings wherein the showings are for purposes of illustrating preferred embodiments of the invention only and not for purposes of limiting same, FIG. 1 shows the general configuration of an adjustable sign holder system according to the present invention for mounting a sign element A on a fixture or support surface B. The sign element A is typically made of paper, cardboard, poster board, chip board, foam core board, plastic or laminates of these materials. However, it should be appreciated that other materials or laminates thereof can also be used. The sign element A is mounted on the fixture B by spaced first and second side support assemblies 10 and 12. The sign element A is retained in the first and second side support assemblies 10 and 12 by physical engagement therein.

Each of these support assemblies is engaged with a respective side edge of the sign element A and also supports the sign element along its bottom edge for a short distance immediately adjacent the two side edges thereof. If the sign element is long, then a bottom support member 16 can also be provided, as illustrated in FIG. 1. The bottom support member 16 engages the sign element A along its bottom edge and provides additional support and stability therefor. While only a single bottom support member 16 is illustrated in FIG. 1, it should be appreciated that additional bottom support members 16 can also be provided if that is considered necessary.

The first and second side support assemblies 10 and 12 are mirror images of each other. Therefore, only the first or right side support assembly 10 will be discussed herein, it being appreciated that the second or left side support assembly has the identical components.

Figure 2:
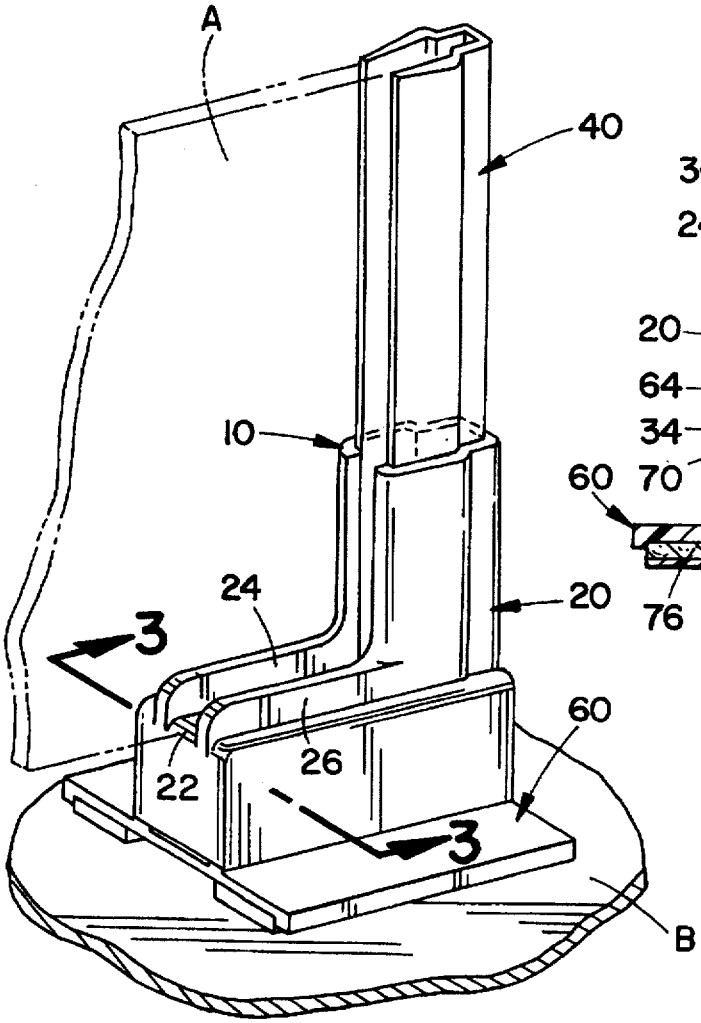
FIG. 2 is an enlarged perspective view of one end of the sign holder system of FIG. 1 illustrating a sign side support assembly according to a first embodiment of the present invention.

With reference now to FIG. 2, the first side support assembly 10 comprises an L-shaped support shoe 20 that includes a substantially horizontally oriented support surface 22 in which a bottom surface of the sign A is supported. The support surface 22 is defined by a pair of spaced first and second flanges 24 and 26.

Figure 4:
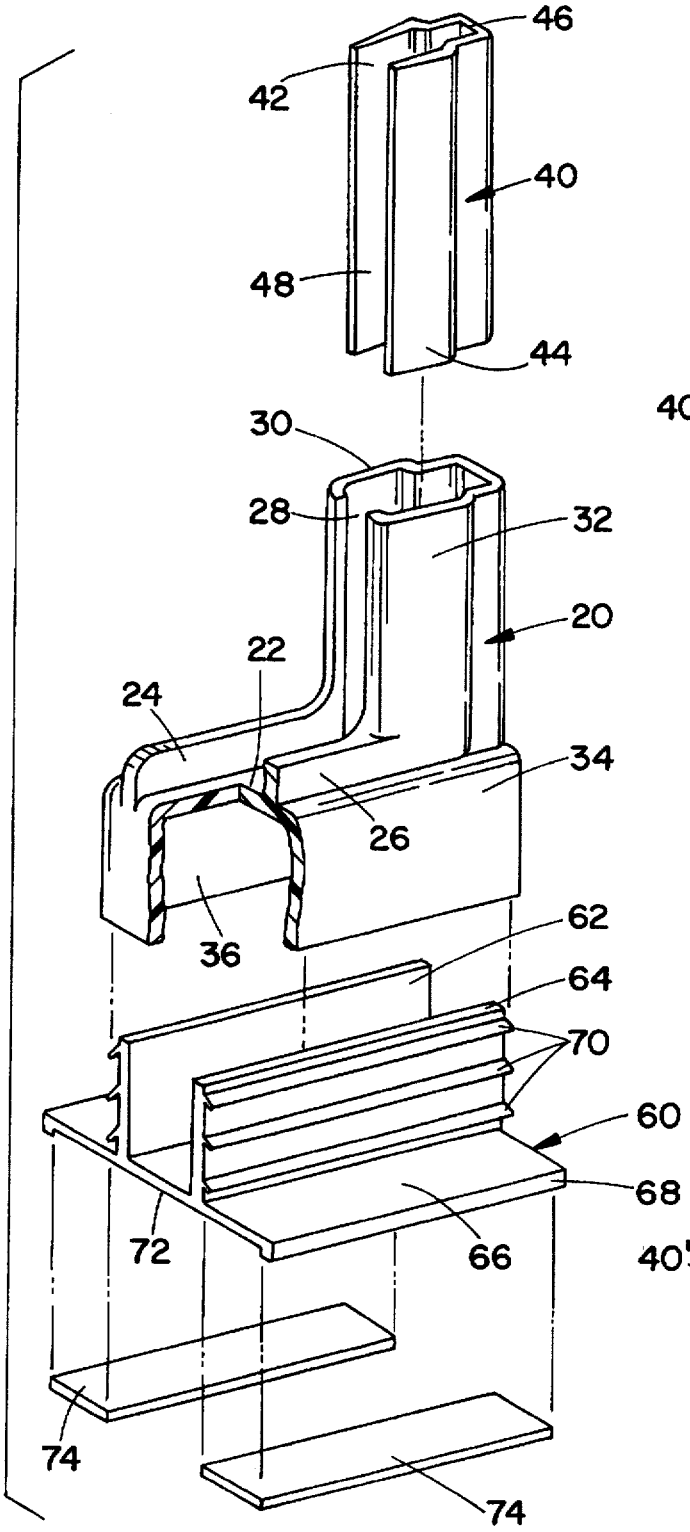
FIG. 4 is an exploded perspective view of the assembly of FIG. 2.

With reference now also to FIG. 4, the support shoe 20 also includes an engagement surface 28 which is defined by spaced third and fourth flanges 30 and 32 which both have a stepped configuration. The stepped configuration of the third and fourth flanges 30 and 32 is such that the flanges approach each other with an increasing depth of the engagement surface 28. It can be seen that the first flange 24 merges into the third flange 28 and the second flange 26 merges into the fourth flange 30. The engagement surface 28 extends substantially vertically and is oriented substantially perpendicular to the support surface 22. A substantially linear groove is defined by the engagement surface 28. The four flanges 24, 26, 30 and 32 are positioned on, and are of one piece with, a rectangular housing 34 in which is defined a recessed area 36.

Figure 5A:
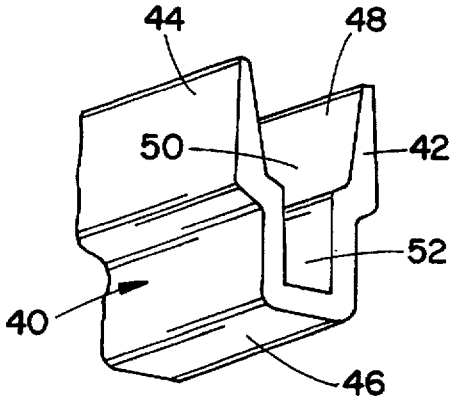
FIG. 5A is an enlarged perspective view of a portion of a rail used in the assembly of FIG. 4.

A sign edge holder, or rail 40, can be slid into the L-shaped support shoe 20 and held therein by a friction fit. The rail is defined by a first wall 42 and a spaced coextensive second wall 44. These are joined along adjacent edges by a base wall 46. The opposed edges of the two walls 42, 44 define an engagement channel 48. It should be appreciated that the walls of the rail 40 are also stepped so as to be accommodated in the third and fourth flanges 30 and 32 defining the engagement surface 28 of the support shoe 20, as is illustrated in FIG. 2. The engagement channel 48 comprises a first tapered engagement section 50 defined by the internal surfaces of the first and second walls 42 and 44 and a second substantially straight walled engagement section 52, which is narrower in diameter than is the first section 50 due to the stepped nature of the side walls of the rail. In other words, the intra wall separation between the first and second walls 42 and 44 substantially decreases with increasing depth as may best be seen in FIG. 5A. The rail 40 extends substantially perpendicularly once it is mounted on the shoe 20.

Preferably, both the support shoe 20 and the rail 40 are made of suitable conventional plastic materials by processes known in the art.

Figure 5B:
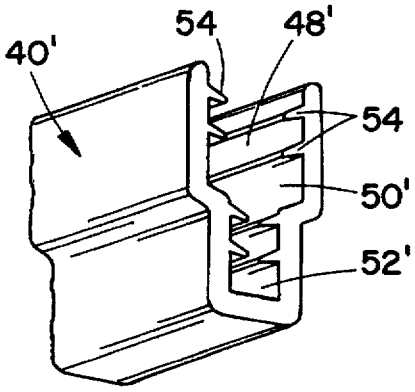
FIG. 5B is an enlarged perspective view of a first alternate rail which can be used in the assembly of FIG. 4.

With reference now also to FIG. 5B, this figure discloses a second embodiment of a rail. For ease of comprehension and appreciation of this alternative, like components will be identified by like numerals with a primed (') suffix and new components will be identified by new numerals.

In this embodiment, a rail 40' includes a first tapered engagement section 50' which is provided with a plurality of fins 54 that extend inwardly into an engagement channel 48'. If desired, similar fins can be provided in a second straight walled engagement section 52' of the rail 40'. The fins are preferably made from a suitable resilient soft plastic material so they can grippingly engage a sign which is slipped thereinto and prevent its easy removal. Preferably, the rail 40' is made of a suitable conventional thermoplastic material, such as PVC via extrusion molding. Preferably the fins are made of a suitable conventional thermoplastic material such as PVC. However, the fins are made of a less hard material than is the rail. The fins can be made simultaneously with the rail by co-extrusion, as is known in the art.

Figure 5C:
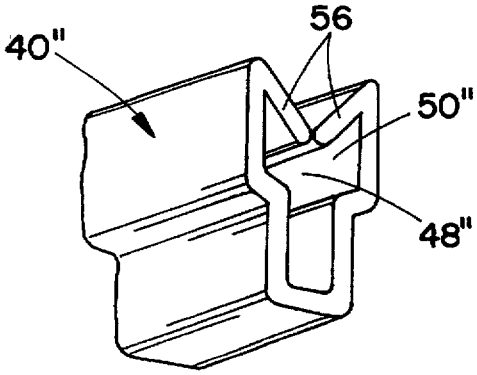
FIG. 5C is an enlarged perspective view of a second alternate rail which can be used in the assembly of FIG. 4.

With reference now also to FIG. 5C, a third embodiment of a rail is disclosed therein. For ease of comprehension and appreciation of this alternative, like components will be identified by like numerals with a double primed (") suffix and new components will be identified by new numerals.

In this embodiment, a rail 40" is provided with a first section 50" which includes a pair of facing lips 56 extending into an engagement channel 48". The lips 56 will flex away from each other to allow for even thin sheets of signage to be securely held by the rail 40" thereby allowing the sign holder system according to the present invention to support even thin signs. It should be appreciated that the rail 40" can be manufactured by a conventional process, such as extrusion molding. While the lips 56 are illustrated to have the same wall thickness as does the rail 40", it should be appreciated that the lips could be made thinner if that were considered advantageous. Moreover, while the lips are shown to have a pair of spaced parallel faces, it should be appreciated that lips with different profiles could also be provided.

Figure 3:
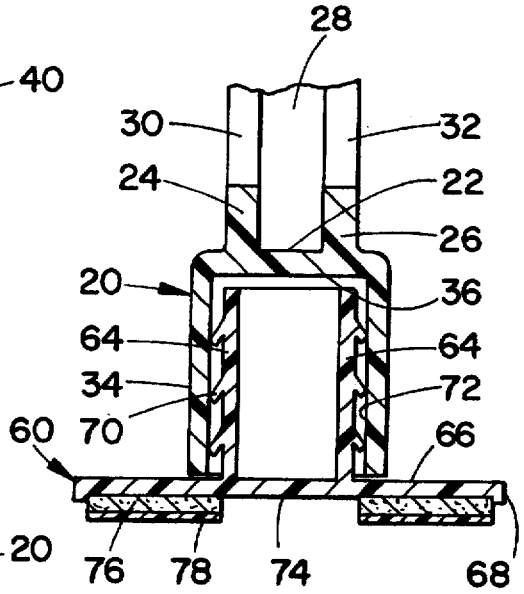
FIG. 3 is a cross-sectional view of the assembly of FIG. 2 along lines 3—3.

With reference again to FIG. 4, the L-shaped support shoe 20 and the rail 40 are supported by a base 60. The base comprises first and second substantially vertically oriented projecting walls 62 and 64 which are spaced from each other. The walls extend away from an upper surface 66 of a substantially horizontal support wall 68. Positioned on the outward facing surfaces of the projecting walls 62 and 64 are a plurality of spaced horizontally extending fins 70 which are oriented downwardly so that they extend toward the upper surface 66 of the support wall 68. As illustrated in FIG. 3, these fins 70 engage the inner walls 72 defining the recess 36 in the housing 34 of the support shoe 20. The fins 70 enable the base 60 to frictionally hold the support shoe 20 and prevent the support shoe from easily being pulled away from the base once the projecting walls 62 and 64 have been inserted in the recess 36, as is illustrated in FIG. 3.

With continued reference to FIG. 3, located on a lower surface 74 of the support wall 68 are a pair of spaced adhesive strips 76. Each of these adhesive strips has its outward face covered by a selectively removable layer of release paper 78 so that the adhesive strip will only contact the fixture B when it is desired to do so. For temporary positioning of the sign holder system on a fixture, it is not necessary to peel the release paper 78 away from the adhesive strips. On the other hand, for permanently affixing the sign holder system, the paper 78 can be removed so that the adhesive strip 76 can contact the fixture surface and become adhered thereto.

The embodiment illustrated in FIGS. 1–4 is useful in situations when a magnetic support element cannot be mounted in the housing recess 36 because the subjacent support surface—such as the support surface B illustrated in FIGS. 1 and 2—is not made of a magnetic field conducting material.

With reference now to FIG. 6, the adjustable sign holder system of the present invention can be employed not only with a subjacent support surface, such as is illustrated in FIGS. 1 and 2, but also with, e.g., ceiling grids 80 to which a pair of side support assemblies 10 and 12 can be secured via the adhesive strips 74 discussed in connection with FIGS. 3 and 4. In this way, a sign 82 can be suspended from the ceiling.

With reference now to FIG. 7, the sign holder system according to the present invention can also be employed in such a manner that a single L-shaped support shoe 20 is utilized, together with a rail 40 and a suitable base 60 along, e.g., a vertically extending shelf member 84. In this embodiment, only the bottom edge of a sign 86 is supported, as well as a small portion of one side edge which engages the support surface 22 of the L-shaped support shoe. In this orientation of the support shoe, however, the support surface 22 is substantially vertically oriented whereas the engagement surface 28 thereof and the engagement channel 48 of the rail 40 are substantially horizontally oriented. It should be recognized that due to the configuration of the sign 86, as well as its location, the top edge of the sign can not be supported with a second rail mounted in a second shoe.

It has been mentioned that the base 60 strongly engages the support shoe 20 due to the fins 70. However, the base 60 can be removed from the L-shaped support shoe 20 when it is desired to do so. This can be accomplished by prying the base projecting walls 62 and 64 out of the housing recess 36 by overcoming the friction force of the fins 70. For example, one can push a screwdriver blade between the base upper surface 66 and the housing 34 between the projecting walls 62 and 64 of the base to push the base out of the shoe. Once the base 60 has been removed, another type of base can be put in its place. A variety of such bases will now be discussed.

Figure 8:
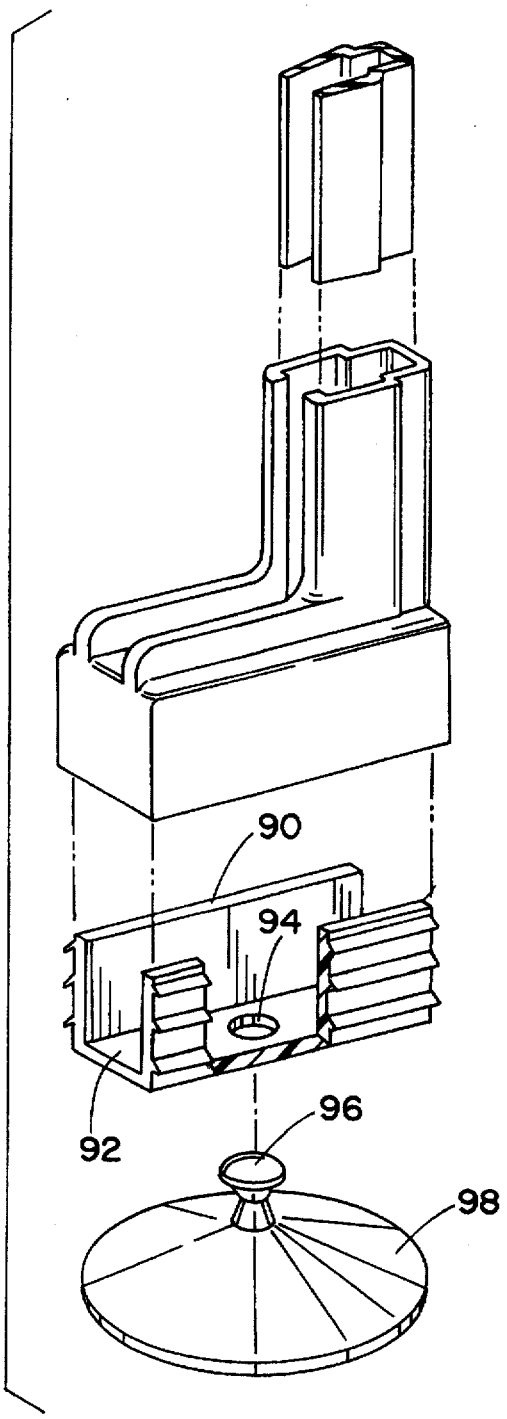
FIG. 8 is an exploded perspective view of a sign side support assembly according to a second embodiment of the present invention.

With reference now to FIG. 8, an alternate embodiment of a side support assembly is there illustrated. In this embodiment, a base 90 includes a bottom wall 92 that is provided with a substantially centrally located through aperture 94. The aperture cooperates with a projection 96 of a suction cup 98. The suction cup enables the base 90, and hence the L-shaped support shoe in which it is inserted, to be supported from a suitably configured support surface.

Figure 9:
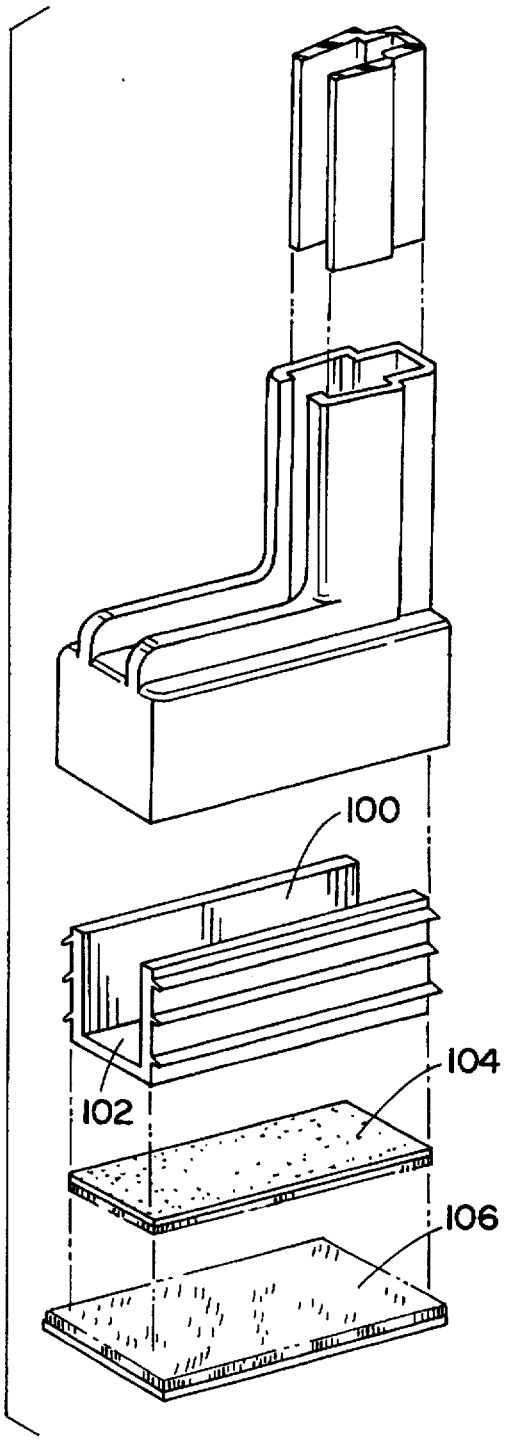
FIG. 9 is an exploded perspective view of a sign side support assembly according to a third embodiment of the present invention.

With reference now to FIG. 9, another type of base 100 is there illustrated. In this embodiment, the base includes a substantially planar bottom wall 102. Secured to an outer surface of the bottom wall—by conventional means, such as an adhesive—is a first strip 104 of a conventional hook and loop material. The first strip of hook and loop material 104 can selectively cooperate with a second strip 106 of a conventional hook and loop material which is secured by conventional means to a support surface (not illustrated). With this embodiment, the base can be selectively attached to and detached from the support surface by selective engagement and disengagement of the first and second strips 104, 106 of hook and loop material with each other. In this way, a support shoe held by the base 160 can be selectively secured to a support surface.

Figure 10:
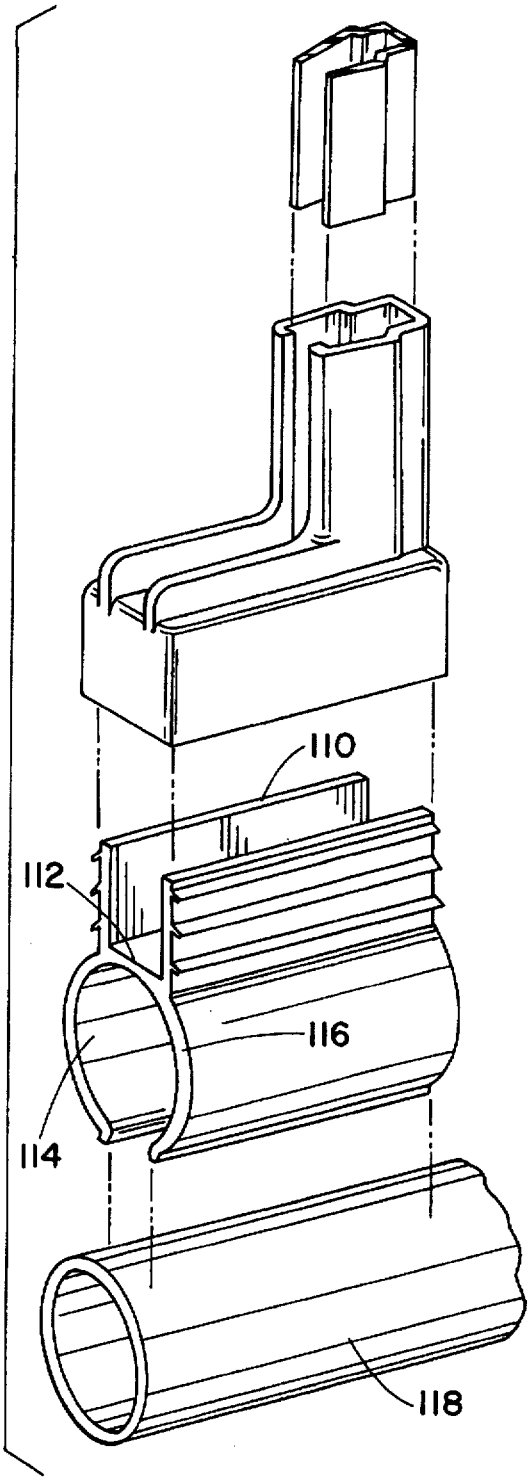
FIG. 10 is an exploded perspective view of a sign side support assembly according to a fourth embodiment of the present invention.

With reference now to FIG. 10, still another embodiment of a base 110 is there illustrated. In this embodiment, the base 110 includes a bottom wall 112 from which extend a pair of curved arms 114 and 116. The arms are curved so as to define a clip member that can be selectively snapped around a fixture in the shape of a cylindrical rail 118. It should be appreciated that with this structure, a sign can be held on the rail in any desired rotational orientation around the longitudinal axis of the rail 118.

Figure 11:
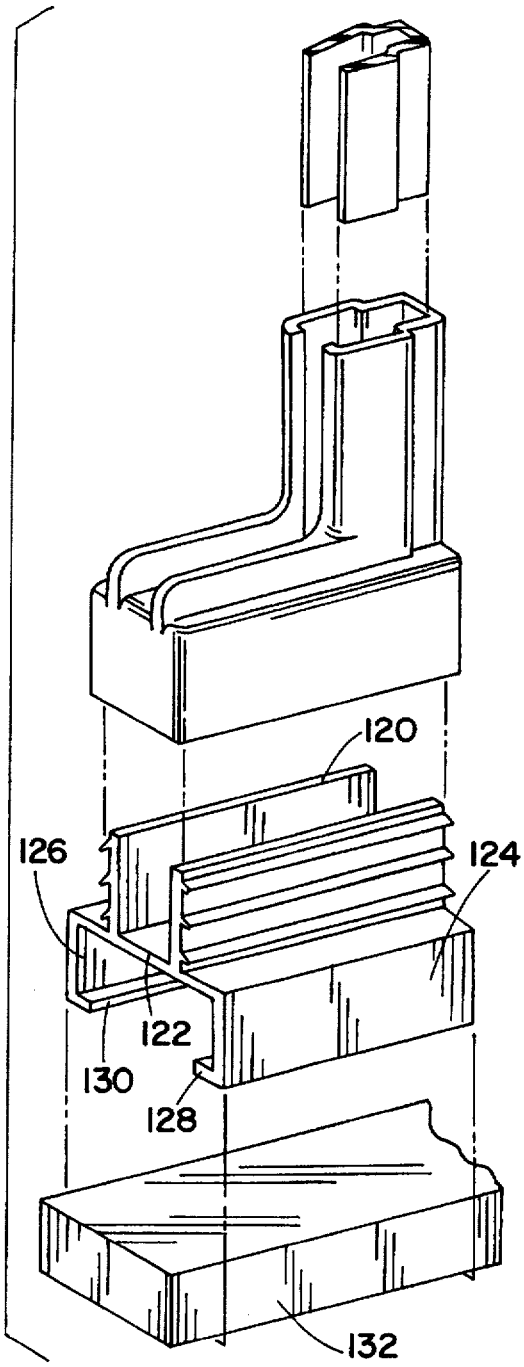
FIG. 11 is an exploded perspective view of a sign side support assembly according to a fifth embodiment of the present invention.

With reference now to FIG. 11, still another type of base 120 is there illustrated. In this embodiment, the base 120 includes a planar bottom wall 122 having a pair of side edges from which extend a pair of flanges 124 and 126 at a substantially normal orientation. Each of the flanges includes at its free edge a lip 128 and 130 extending normal thereto so that the lips face each other. This base design is meant for use on a rectangular gondola top 132 such that the lips snap over the sides of the gondola top and engage a bottom wall thereof. This keeps the base in position and hence the support shoe to which the base is secured.

Figure 12:
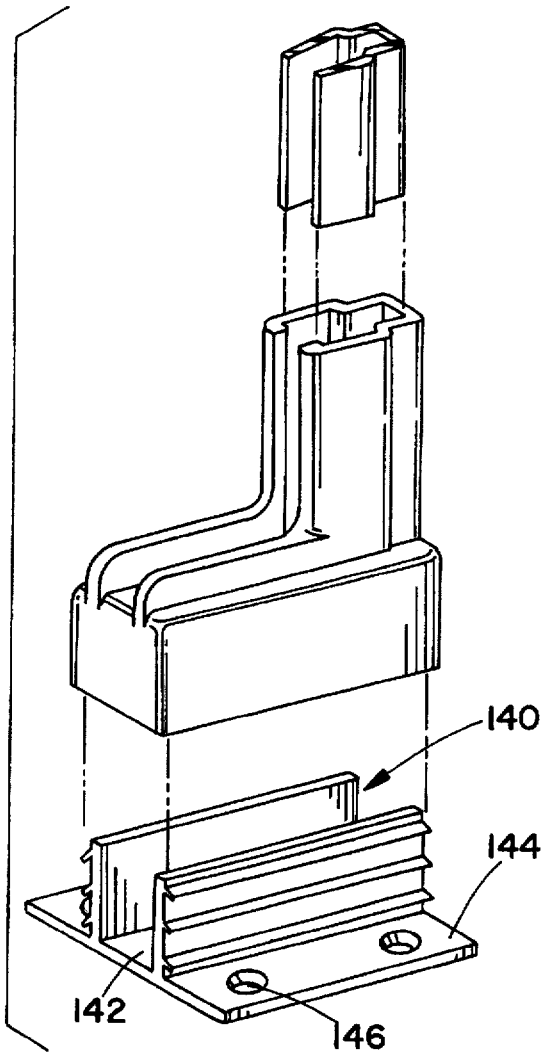
FIG. 12 is an exploded perspective view of a sign side support assembly according to a sixth embodiment of the present invention.

With reference now to FIG. 12, still another embodiment of a base 140 is there illustrated. In this embodiment, the base 140 includes a planar bottom wall 142 which is provided with a pair of wings 144. Each of these wings has at least one aperture 146 extending therethrough. These apertures serve as mounting holes for mounting the base to a subjacent support surface, such as a conventional perforated shelf, via suitable conventional fasteners, such as screws, pop rivets, clips and the like.

Figure 13:
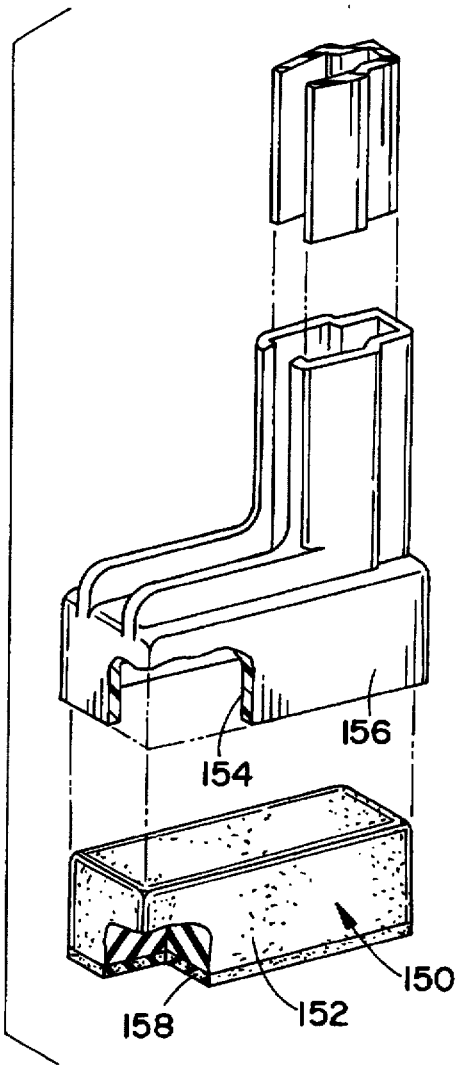
FIG. 13 is an exploded perspective view of a sign side support assembly according to a seventh embodiment of the present invention.

With reference now to FIG. 13, a different type of holding means is there illustrated. In this design, a magnetic base 150 is provided along the lines of the base which is described in U.S. Pat. No. 4,960,258. The base 150 is secured via adhesive 152 on its outer surface in a recess 154 defined in a housing 156 of a support shoe. However, in order to eliminate a scratching by the magnetic base of the subjacent support surface, the base is provided on its bottom surface with a coating 158, preferably made of rubber.

Figure 14:
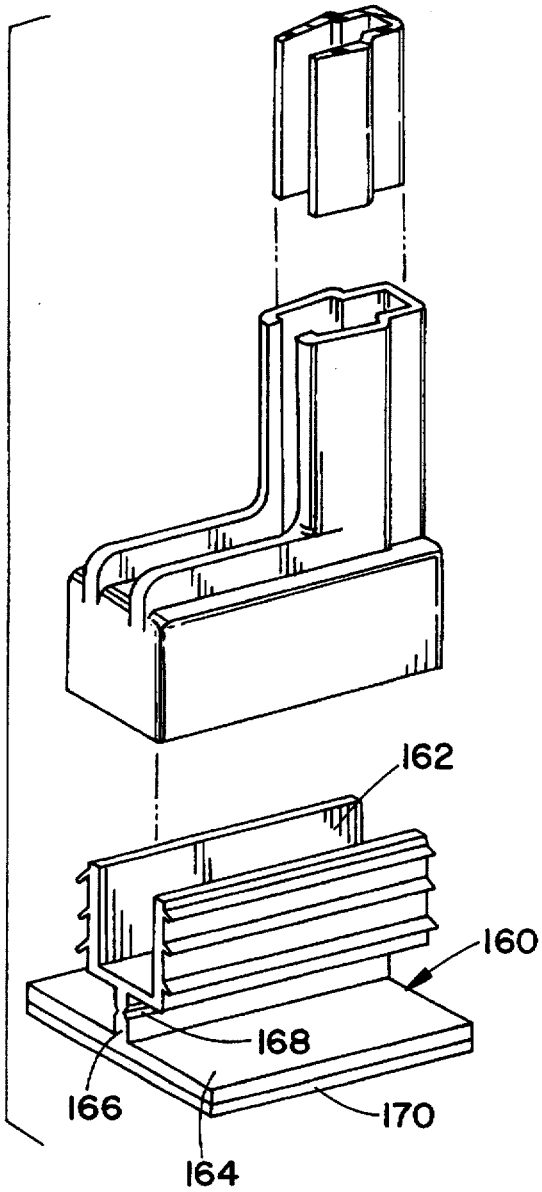
FIG. 14 is an exploded perspective view of a sign side support assembly according to an eighth embodiment of the present invention.

With reference now to FIG. 14, another form of base 160 is there illustrated. In this design, a U-shaped upper section 162 of the base is connected to a planar bottom section 164 thereof by a centrally located connecting arm 166. Defined in the arm is a living hinge 168. This design enables the unit to swing sideways, when it is bumped, and deflect out of the way. The living hinge enables the unit to return again to its upright position. The base 160 can be made of a suitable conventional thermoplastic material which allows a living hinge to be integrally formed therein. It is to be noted that this base has an adhesive strip 170 along its bottom surface to secure it to a fixture if desired.

Figure 15:
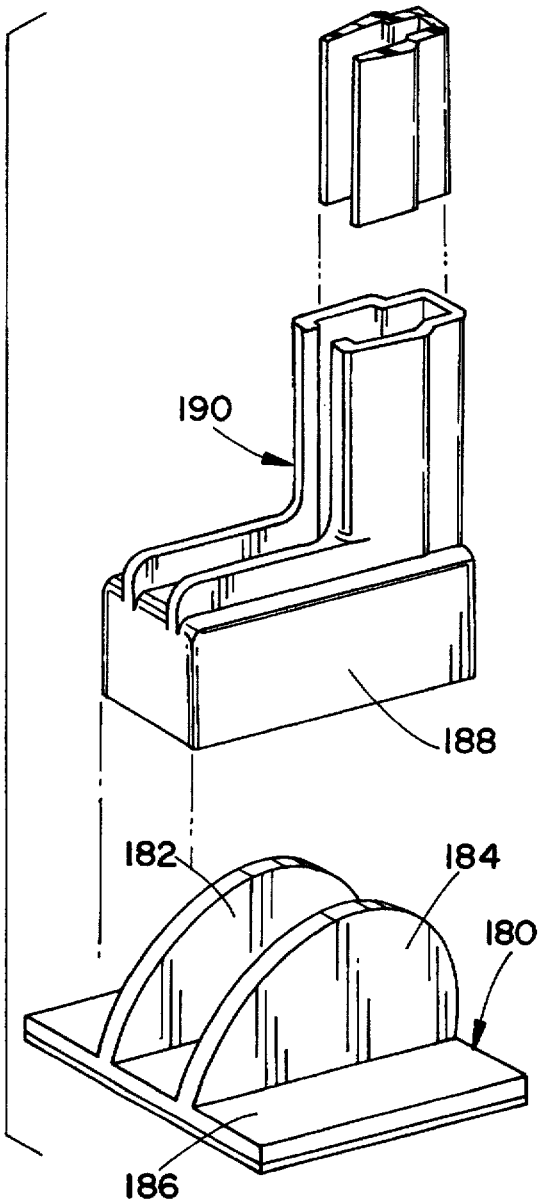
FIG. 15 is an exploded perspective view of a sign side support assembly according to a ninth embodiment of the present invention.

With reference now to FIG. 15, yet another form of base 180 is there illustrated. In this embodiment, the base comprises a pair of semi-circular spaced vertically oriented arms 182 and 184 which extend away from a planar horizontally oriented bottom section 186. Unlike the embodiments illustrated in FIGS. 1–4, 8–12 and 14 where fins are employed to secure the base projections in a housing recess, the embodiment of FIG. 15 illustrates a friction fit between the arms 182 and 184 and a recess (not visible) in a housing 188 of an L-shaped support shoe 190. The advantage of the semi-circular arms and a friction fit between the arms and the housing 188 is that the L-shaped support shoe is able to be rotated angularly in relation to a vertical axis so that the L-shaped support shoe can display a sign element at an angle to the vertical.

Figure 16:
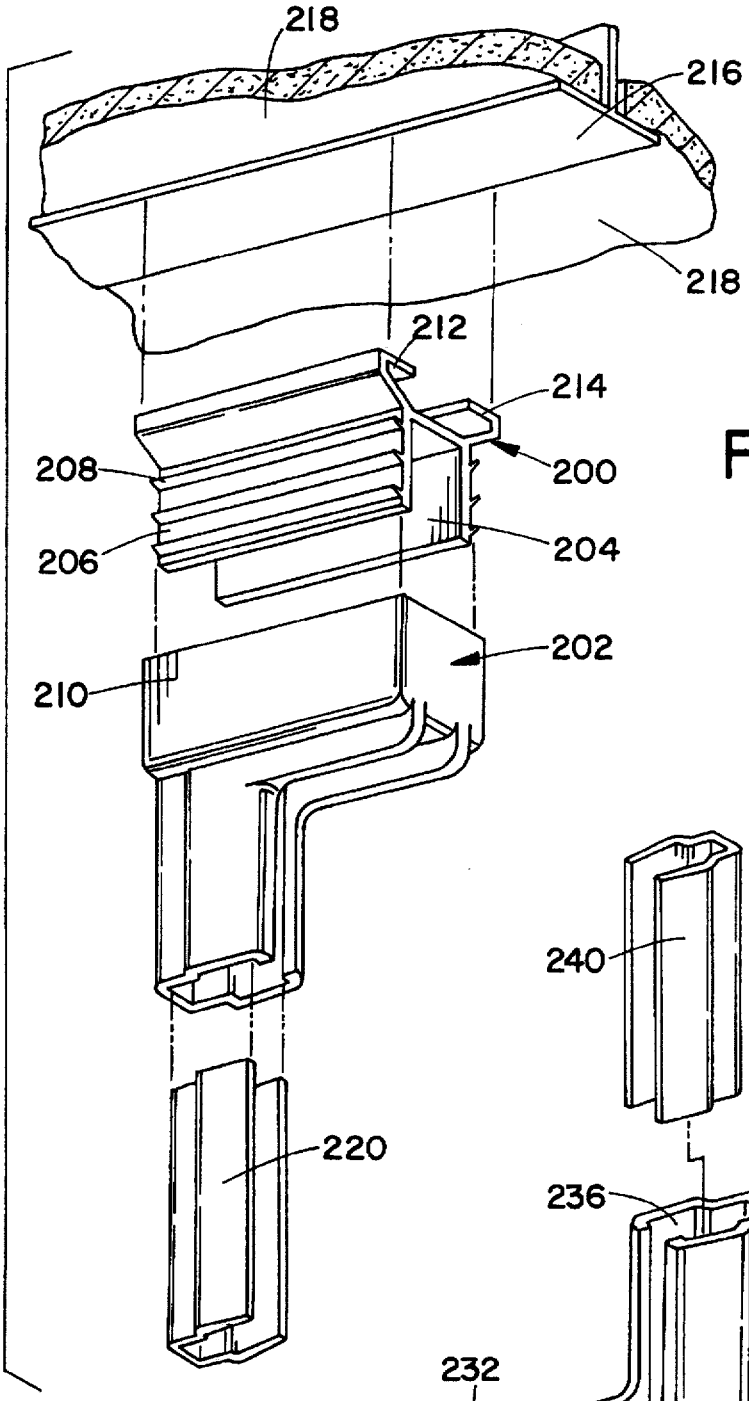
FIG. 16 is an exploded perspective view of a sign side support assembly according to a tenth embodiment of the present invention.

FIG. 16 illustrates still yet another embodiment of a base 200 for an L-shaped support shoe 202. In this embodiment, the base 200 comprises a pair of spaced coextensive arms 204 and 206 which each have secured to their outwardly facing surfaces fins 208 that enable the base 200, when it is slipped into a recess (not visible) in a housing 210 of the L-shaped shoe 202, to hold the base therein. The base also comprises a pair of wings 212 and 214 which have free ends that extend toward each other. The wings enable the base 200 to be snapped over a planar conventional ceiling grid 216 which supports ceiling tiles 218, as is known in the art. With this construction, the L-shaped shoe 202 is oriented in an upside down configuration from that illustrated, e.g., in FIG. 2. With the orientation illustrated in FIG. 16, a suitable sign can be held by the shoe 202 and by a rail 220 secured to 6he shoe and hung from a ceiling, in the manner illustrated in FIG. 6.

As mentioned in connection with FIG. 1, a bottom support member 16 can also be employed. This support member includes a housing with a recess formed therein substantially along the lines of the housing 34 and recess 36 illustrated, e.g., in FIG. 4. It should be appreciated that any of the bases illustrated in FIGS. 3–16 can be employed with the bottom support member 16 illustrated in FIG. 1, as may be necessary for a particular environment.

Figure 17:
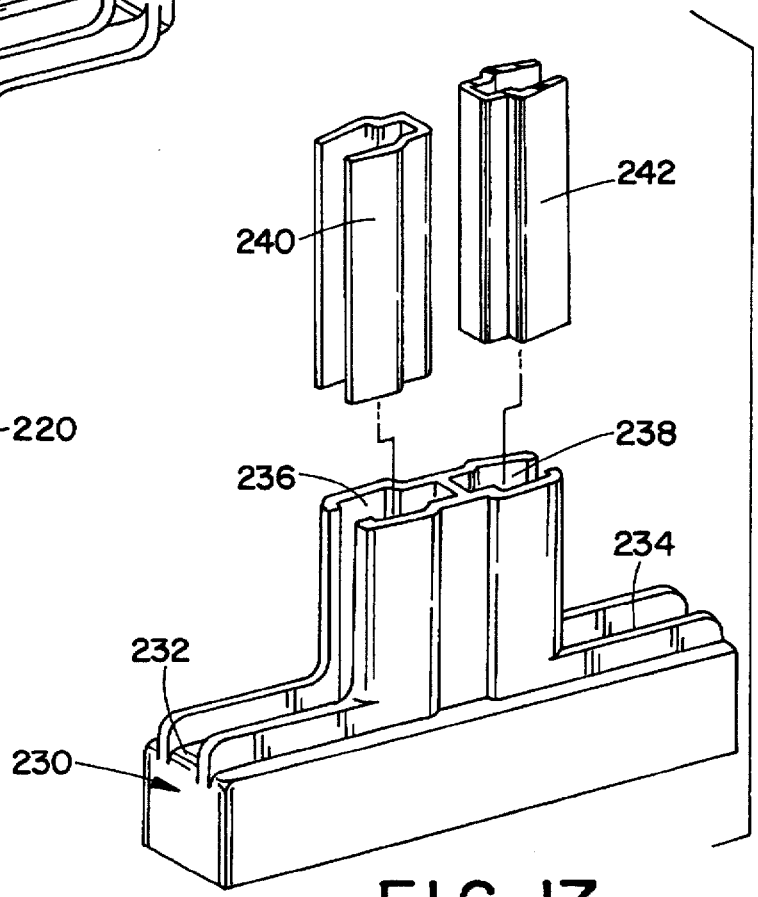
FIG. 17 is an exploded perspective view of a back to back sign side support assembly according to the present invention; and, FIG. 18 is an exploded perspective view of a sign holder system which employs a frame around three sides of a sign, according to the present invention.

FIG. 17 illustrates another embodiment for a shoe. In this embodiment, a shoe 230 is a one piece molded version of two back to back L-shaped shoes. Therefore, the shoe comprises two support surfaces 232 and 234 and two engagement surfaces 236 and 238. The engagement surfaces are able to cooperate with a pair of rails 240 and 242. With this embodiment, one is able to bring a pair of signs next to each other and hold their adjacent side edges with a single shoe 230.

Figure 18:
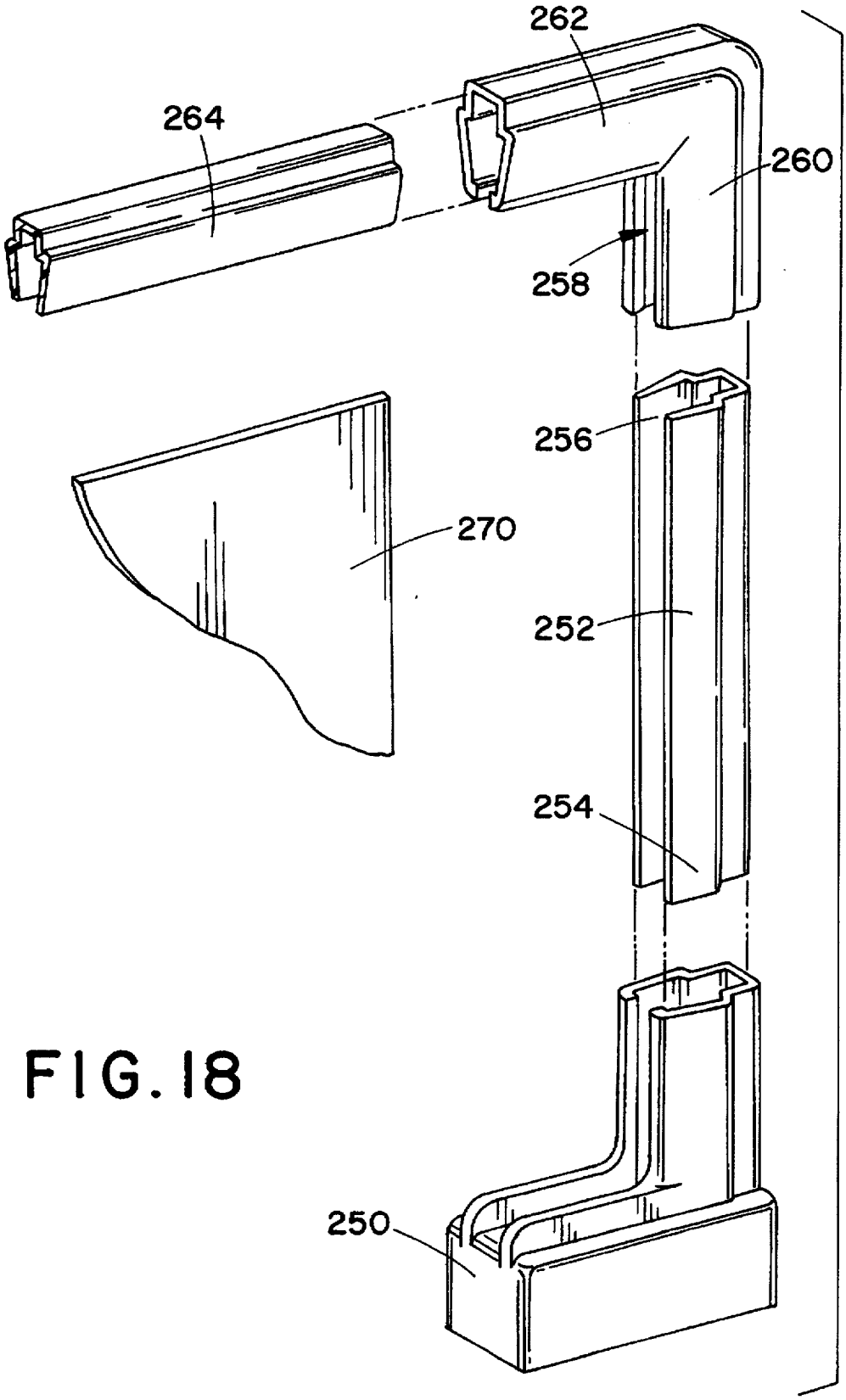

Finally, FIG. 18 illustrates yet another embodiment of an adjustable sign holder system. In the embodiment shown in FIGS. 1 and 2, a frameless sign holder system is depicted. In contrast, FIG. 18 illustrates a framed sign holder system. The system comprises a shoe 250 and a rail 252 having its lower end 254 held in the shoe while an upper end 256 thereof is held in a corner piece 258. The corner piece is L-shaped and includes a first section 260 for accommodating the upper end 256 of the rail and a second section 262, oriented substantially normal to the first section 260. The second section 262 accommodates an end of a top rail 264 of the system. It should be appreciated that the other side of the frame system has the identical components. With this embodiment, three sides of a sign element can be supported, should that be considered necessary. Therefore, with this system, the two side edges and the top edge of a sign are held by the respective rails, shoes and corner pieces. This embodiment of the invention may be useful in certain environments where it may be necessary to hold three edges of a sign.

In addition, this embodiment would be useful in environments other than sign holding. For example, a suitable conventional dry wipe board 270 or other writing surface board can be held in the framed system illustrated in FIG. 18. The board so held can then be secured via any of the numerous types of bases illustrated in FIGS. 3–16 to a suitable fixture either permanently or temporarily. The board can be, e.g., a dry wipe board or dry erase board of the type which is manufactured by a number of different corporations, such as Magna Visual, Marsh Chalk-board and the presentation boards manufactured by Quartet, Inc. and by Davson, a subsidiary of Rubbermaid.

While FIG. 18 illustrates that three sides of the dry erase board or presentation board are secured in a frame, it would be possible—by suitably configuring the L-shaped shoe 250—to also enclose via an edge frame the fourth side thereof.

The invention has been described with reference to a number of preferred embodiments. Obviously, modifications and alterations will occur to others upon a reading and understanding of the preceding specification. It is intended that the invention be construed as including all such alterations and modifications insofar as they come within the scope of the appended claims or the equivalents thereof.

I claim:

1. An apparatus for supporting a planar element on a fixture comprising:

a left side support member and a right side support member, each of said support members being separated from the other and being free standing, each of said left and right side support members including a support surface and an engagement surface oriented substantially normal to said support surface;

a substantially linear groove located along a length of said engagement surface of each of said left and right side support members; and, a left side base and a right side base on which a respective one of said left side and right side support members is mounted, wherein at least one of said left side support member and said right side support member includes a housing having a recess and wherein at least one of said left side base and said right side base comprises:

a projection extending into said recess of said support member housing, a securing means extending outwardly from said projection for fastening said projection in said recess of said support member housing, and a support wall on which said projection is mounted, said support wall having a larger circumference than a circumference of said one of said left side base and said right side base.

2. The apparatus of claim 1 wherein said securing means comprises a resilient fin mounted on said projection and engaging an inner wall of said recess of said support member housing.

3. The apparatus of claim 1 wherein said one of said left side base and said right side base further comprises:

a layer of adhesive on said support wall for securing said base to a subjacent support surface; and, a strip of release paper which covers said layer of adhesive to prevent contact of said adhesive with the subjacent support surface until desired.

4. The apparatus of claim 1 wherein said one of said left side base and said right base further comprises a fastener mounted on said support wall for securing said base to the fixture.

5. The apparatus of claim 1 wherein said one of said left side base and said right side base further comprises a strip of hook and loop fastening material mounted on said support wall, said strip of hook and loop material cooperating with another strip of hook and loop material for mounting on the fixture to secure said base to the fixture.

6. The apparatus of claim 1 wherein said one of said left side base and said right side base further comprises a clip for engaging the fixture.

7. The apparatus of claim 1 further comprising a pair of side rails, one of which is mounted in each of said side grooves of said left side support member and said right side support member and wherein each of said rails comprises a pair of spaced side walls.

8. The apparatus of claim 7 wherein each of said rails further comprises a lip extending inwardly from each of said pair of side walls, said lips cooperating for holding an edge of an associated sign.

9. The apparatus of claim 7 further comprising:

a top rail; and, a pair of corner pieces for securing respective ends of said top rail to an upper end of each of said side rails to form a frame system for the associated sign.

10. The apparatus of claim 1 wherein said support wall of said base comprises:

a central section from which said projection extends;

a first leg projecting from said central section; and, a second leg projecting from said central section in a spaced manner from said first leg.

11. An apparatus for mounting a sign element on a fixture comprising:

a free standing left side support member, said support member being L-shaped and including a support section and an engagement section oriented substantially transverse to said support section, and a substantially linear side groove located along a length of said engagement section;

a free standing right side support member spaced from said left side support member, said support member being L-shaped and including a support section and an engagement section oriented substantially transverse to said support section and a substantially linear side groove located along a length of said engagement section of each of said left and right support members;

a left side base on which said left side support member is mounted; and, a right side base on which said right side support member is mounted wherein each of said left side support member and said right side support member includes a housing having a recess and wherein each of said left side base and right side base comprises:

a projection extending into said recess of said respective support member housing, a securing lip extending outwardly from said projection for fastening said projection in said recess of said support member housing, and a support wall on which said projection is mounted.

12. The apparatus of claim 11 wherein said securing lip comprises a resilient fin mounted on said projection and engaging an inner wall of said recess of said support member housing.

13. The apparatus of claim 11 further comprising a hinge connecting said support wall to said projection to allow said projection to pivot in relation to said support wall.

14. The apparatus of claim 11 wherein at least one of said left side base and said right side base further comprises a clip which engages the fixture.

15. An apparatus for mounting a sign element on a fixture, comprising:

a free standing support member, said support member being L-shaped and including a support section and an engagement section oriented substantially transverse to said support section, and a substantially linear groove located along a length of said engagement section;

a rail which can be mounted in said groove wherein said rail comprises a pair of side walls which taper towards each other; and, a base on which said support member is mounted; said base for, contacting the fixture wherein said support member includes a housing having a recess and wherein said base comprises:

a projection extending into said recess of said support member housing, a securing means extending outwardly from said projection for fastening said projection in said recess of said support member housing, and a support wall from which said projection extends, said support wall extending past at least one side of said projection.

16. The apparatus of claim 15 wherein said rail further comprises a lip extending inwardly from each of said side walls for holding an edge of an associated sign.

17. The apparatus of claim 15 wherein said support wall of said base comprises:

a central section from which said projection extends;

a first leg projecting from said central section and a second leg projecting from said central section in a spaced manner from said first leg.

18. The apparatus of claim 17 wherein said first and second legs project from opposing sides of said central section.

19. The apparatus of claim 15 further comprising a layer of adhesive located on said support wall for securing said base to a subjacent support surface, said layer of adhesive being located on a side of said support wall opposite to a side from which said projection extends.

20. The apparatus of claim 19 further comprising a strip of release paper which covers said layer of adhesive to prevent contact of said adhesive with the subjacent support surface until desired.

21. The apparatus of claim 15 wherein said securing means comprises a resilient fin mounted on said projection and engaging an inner wall of said recess of said support member housing.

* * * * *